United States Patent [19]

Eto

[11] Patent Number: 4,600,818

[45] Date of Patent: Jul. 15, 1986

[54] LEVER SWITCH

[75] Inventor: Katsuo Eto, Numazu, Japan

[73] Assignee: Toshiba Kikai Kabushiki Kaisha, Tokyo, Japan

[21] Appl. No.: 676,174

[22] Filed: Nov. 29, 1984

[30] Foreign Application Priority Data

Nov. 30, 1983 [JP] Japan ..... 58-184990[U]

[51] Int. Cl.[4] ..... H01H 3/12

[52] U.S. Cl. ..... 200/5 R; 200/153 T; 200/DIG. 29

[58] Field of Search ..... 200/5 R, 153 T, 1 B, 200/DIG. 29, 18, 17 R, 153 LB, 153 LA

[56] References Cited

U.S. PATENT DOCUMENTS 2,957,536 10/1960 Ulinski ..... 200/153 T X 3,578,930 5/1971 Rosenheim ..... 200/153 T 4,138,603 2/1979 Hudimac, Jr. ..... 200/153 T

*Primary Examiner*—J. R. Scott

*Assistant Examiner*—Morris Ginsburg

*Attorney, Agent, or Firm*—Birch, Stewart, Kolasch & Birch

[57] ABSTRACT

A lever switch includes a plurality of microswitches arranged along a line and having respective pushbuttons, first pressing members disposed in confronting relation to the pushbuttons, respectively, a second pressing member arranged for displacement with respect to the first pressing members for selective engagement therewith, and a lever member for displacing the second pressing member to selectively displace the first pressing members for selectively pressing the pushbuttons to switch the microswitches.

8 Claims, 6 Drawing Figures

LEVER SWITCH

BACKGROUND OF THE INVENTION

The present invention relates to a lever switch, and more particularly to a lever switch composed of a plurality of microswitches arranged along a straight or circular line and having respective pushbuttons, and a plurality of rolling bodies such as balls disposed in facing relation to the pushbuttons, the rolling members being selectively depressable in response to the actuation of a lever member for energizing and de-energizing a desired microswitch.

Various switches are widely used for making and breaking electric circuits through angular movement of lever members. A typical example of conventional lever switches of the type described is illustrated in FIG. 1. The illustrated prior lever switch includes a base 2 made of an electrically insulating material and supporting holders 4 bent at about 90° and erected thereon. Fixed contacts 6 are each mounted on one flat portion of each of the holders 4, while a bolt 8 is threaded through the other flat portion of each holder 4 and joined to a conductor 10. The holder 4, contact 6, bolt 8, and conductor 10 jointly constitute a fixed contact assembly 12, and a plurality of such fixed contact assemblies 12 are mounted on the base 2 in 90°-spaced positions. A slide 14 is disposed between each pair of fixed contact assemblies 12. the slide 14 comprises a roller 16 and a support 18 on which the roller 16 is rotatably supported, the support 18 being mounted centrally on a plate member 20. The plate member 20 has movable contacts **22*a*, 22*b* on its opposite ends and is resiliently supported by compression coil springs 26*a*, 26*b* extending from a support base 24**.

The roller 16, support 18, plate member 20, movable contacts **22*a*, 22*b*, and springs 26*a*, 26*b* jointly serve as a movable contact assembly 28, and a pair of such movable contact assemblies 28 is mounted on the base 2. The rollers 16 of the movable contact assemblies 28 are positioned in mutually confronting relation to each other. Between the rollers 16, 16, there is disposed a cam 32 having two semicircular recesses 30*a*, 30*b* and rotatably supported by a shaft 34** coupled to a lever, not shown.

Operation of the switch thus constructed will be described. Under normal or inoperative condition, the peripheral surface of the cam 32 is pressed against the peripheral surfaces of the rollers 16, 16 to push the plate members 20 of the movable contact assemblies 28 toward the ends of the base 2 against the resilience forces of the compression coil springs **26*a*, 26*b*. The movable contacts 22*a*, 22*b* are therefore held out of contact with the fixed contacts 6, 6**, and electric circuits connected to the switch are kept open.

When the non-illustrated lever is turned, one of the rollers 16 pressed against the peripheral surface of the cam 32 rolls and enters into the recess **30*a*. At this time, the compression coil springs 26*a*, 26*b* under compression are expanded under their own resiliency to displace the movable contacts 22*a*, 22*b* on the plate member 20 into contact with the fixed contacts 6, 6, allowing an electric current to flow from one of the conductors 10 to the other in the direction of the arrows. Thus, one of the electric circuits (which is the upper electric circuit in FIG. 1**) is closed.

Continued rotation of the lever causes the other electric circuit (which is the lower electric circuit in FIG. 1) to be closed, and also causes the upper electric circuit to be opened.

With the above structure, however, the plate member 20 is angularly displaced unless the movable contacts **22*a*, 22*b* are substantially translated under the resilient forces from the pair of coil springs, and if the plate member 20 is angularly displaced, then the movable contacts 22*a*, 22*b* fail to contact the fixed contacts 6, 6**. Therefore, the resilient forces of the paired coil springs have to be equal to each other. If the coil springs become unable to to produce sufficient resilient forces due for example to a deposit of dust, then the electric circuits cannot be closed as desired.

The cam and movable contacts are mostly fabricated as molded parts. If these molded parts are dimensionally varied, then no sufficient and reliable operation to open and close the electric circuits can be achieved. Since the rotating cam and the other movable parts are disposed in close proximity to the contacts, if one of these parts is damaged or broken, a malfunction will result or no circuit opening and closing operation will be effected at all. The conventional construction therefore fails to sufficiently meet the demand of recent control apparatus which employ many semiconductor circuit devices for controlling operation at a low voltage and a small current.

SUMMARY OF THE INVENTION

The present invention has been made in an effort to overcome the above shortcomings.

It is an object of the present invention to provide a lever switch having two or more commercially available microswitches which will operate reliably at a low voltage and a small current, the microswitches being arranged along a straight or circular line, and steel balls or rollers each disposed as a presser member close to a pushbutton of one of the microswitches, the arrangement being such that the steel balls or rollers are selectively pushed in response to the operation of a lever member for thereby pressing the pushbutton to close or open reliably an electric circuit in the microswitch. The lever switch is of a simple construction, can be manufactured inexpensively, and will operate stably and reliably through separation between the electric circuit and the switching mechanism.

According to the present invention, there is provided a lever switch comprising a plurality of microswitches arranged along a line and having respective pushbuttons, first pressing members disposed in confronting relation to the pushbuttons, respectively, a second pressing member arranged for displacement with respect to the first pressing members for selective engagement therewith, and a lever member for displacing the second pressing member to selectively displace the first pressing members for selectively pressing the pushbuttons to open or close the microswitches.

Each of the first pressing members may comprise a rolling body. The rolling body may comprise a spherical body. The spherical body may comprise a steel ball. Alternatively, the rolling body may comprise a roller. The second pressing member may comprise a plate having tapered opposite edges or a plate having rounded opposite edges.

The lever switch also includes a support on which the microswitches are supported in juxtaposed relation, and a holder plate on which the first pressing members are rotatably supported.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
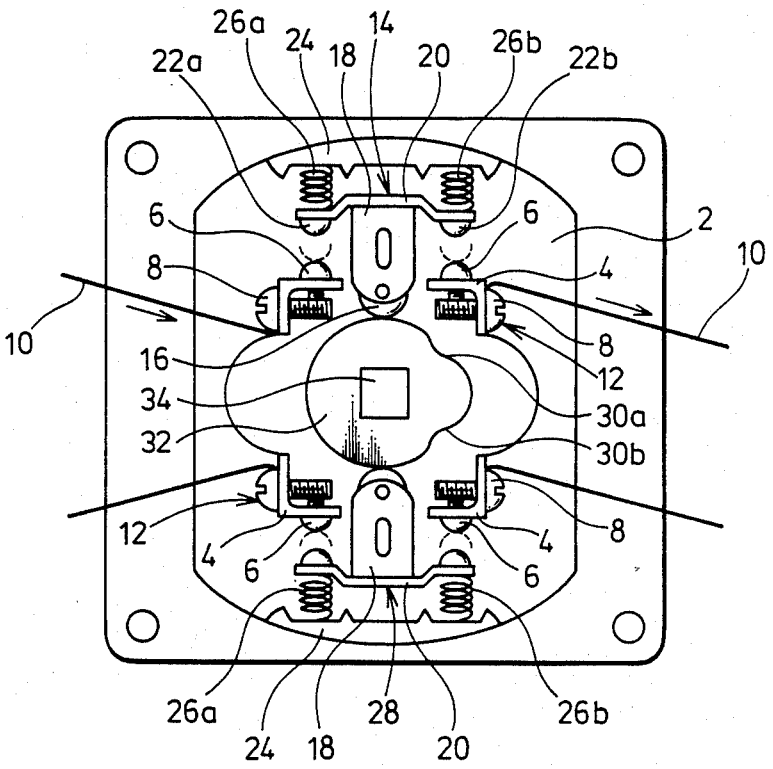
Fig.1 PRIOR ART
FIG. 1 is a schematic plan view of a conventional lever switch.
Figure 2:
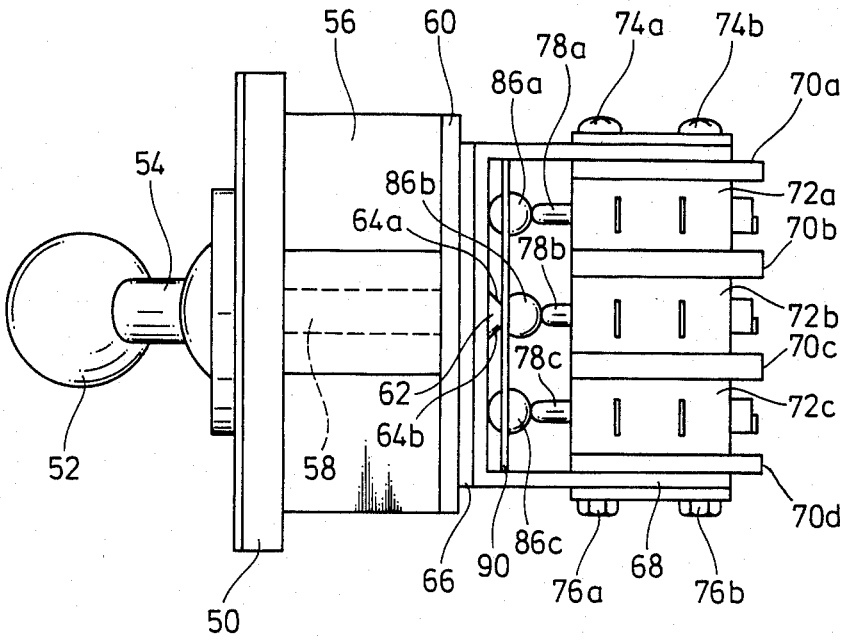
FIG. 2 is a plan view of a lever switch according to the present invention.

FIG. 2 illustrates a lever switch according to an embodiment of the present invention. The lever switch includes a base 50 on which a lever member 54 with a knob 52 mounted on its end is disposed. A circular casing 56 is attached to the rear side of the base 50. A shank 58 extends from the lever member 54 substantially centrally through the casing 56 and has an end exposed out of the casing 56. The exposed end of the shank 58 supports a second presser member or pressing plate 62 rotatable along a side wall of support 68. The slidable pressing plate 62 should preferably have opposite tapered edges 64*a*, 64*b*, as shown in FIG. 2.

Figure 3:
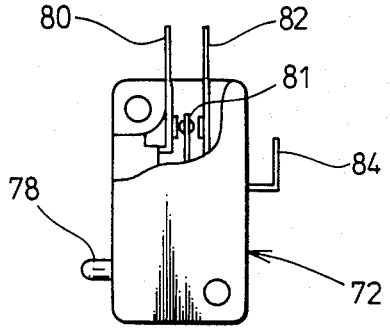
FIG. 3 is a side elevational view, partly cut away, of a microswitch incorporated in the lever switch of the present invention.

To the side wall 60, there is fixed a thin plate 66 on which a channel-shaped suport 68 is mounted. The support 68 accommodates in its inner space four insulating plates 70*a*, 70*b*, 70*c*, 70*d* and juxtaposed microswitches 72*a*, 72*b*, 72*c*. The microswitches and the insulating plates are clamped in position by bolts 74*a*, 74*b* and nuts 76*a*, 76*b*. The microswitches 72*a* through 72*c* have pushbuttons 78*a*, 78*b*, 78*c* extending toward the lever member 54. FIG. 3 shows one preferred example of such microswitch. More specifically, each of the microswitches has on its upper side a first fixed contact 80 and a second fixed contact 82 which serve as switching contacts, a common contact 84 on one side wall, with the pushbutton 78 on an opposite side, and a movable contact 81 disposed in the microswitch. The microswitches 72*a* through 72*c* are commercially available and of the same construction, and hence their internal construction will not be described.

Steel balls 86*a*, 86*b*, 86*c* serving as first pressing members are disposed in confronting relation to the pushbuttons 78*a*, 78*b*, 78*c*, respectively. A holder plate 90 with circular holes 88*a*, 88*b*, 88*c* defined therein (FIG. 4) is positioned in and extends across the support 68. The holes 88*a* through 88*c* have substantially the same diameter as that of the steel balls 86*a* through 86*c*, which are rotatably fitted in the holes 88*a* through 88*c*, respectively. FIG. 5 shows a modification in which rectangular holes 89*a* through 89*c*, rather than the circular holes 88*a* through 88*c*, are defined in the plate 90, and cylindrical rotatable members such as roller bearings 91*a* through 91*c* are fitted in the holes 89*a* through 89*c*, respectively. As illustrated in FIG. 2, the steel balls 86*a* through 86*c* have side portions pressed against the pushbuttons 78*a* through 78*c*, respectively, while opposite side portions of the steel balls are held in contact with the bottom of the support 68, since the pushbuttons 78*a* through 78*c* are pushed under the resilient forces of leaf springs (not shown) mounted in the microswitches.

Figure 4:
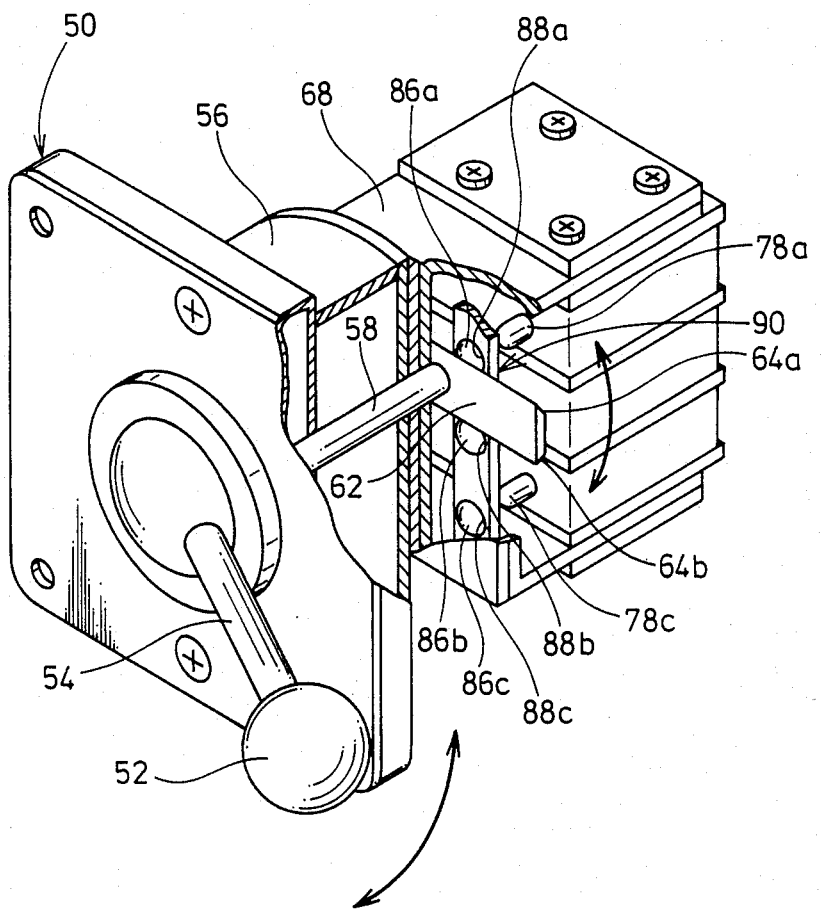
FIG. 4 is a perspective view, with parts broken away, of the lever switch of the present invention.
Figure 5:
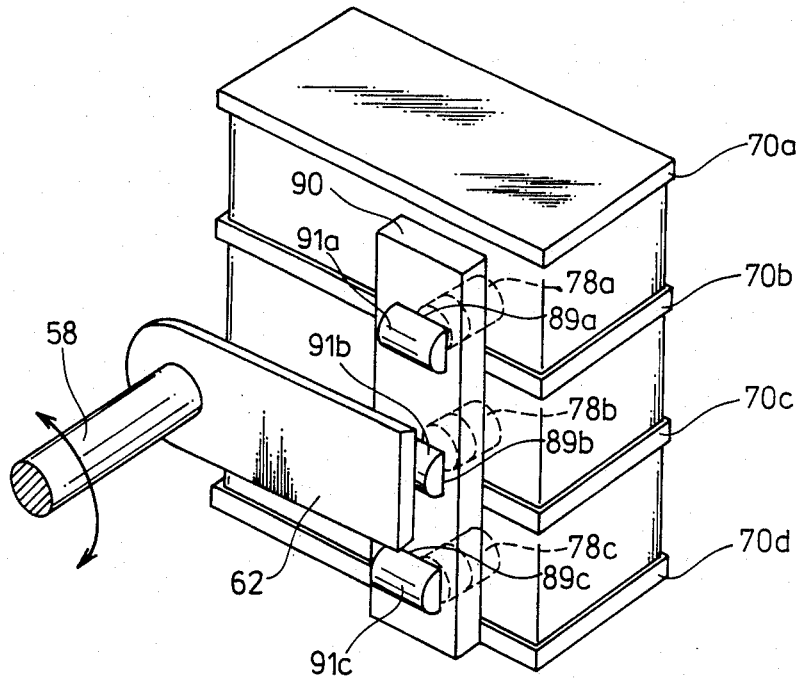
FIG. 5 is a perspective view, with parts omitted from illustration, of a lever switch according to another embodiment of the present invention.

At this time, the slidable plate 62 is positioned between the support 68 and the plate 90, as shown in FIGS. 2 and 4.

The lever switch of the present invention is basically of the above construction, and operation and advantages thereof will be described hereinbelow.

When the lever member 54 is turned while the knob 52 is gripped, the turning force is transmitted to the shank 58 to turn the slidable plate 62 similarly to the lever member 54. As a result, the slidable plate 62 slides along the bottom of the support 68 until it engages the steel ball 86*a*. Further turning movement of the lever member 54 causes the slidable plate 62 to enter below the steel ball 86*a* at the tapered edge 64*a* thereby the steel ball 86*a* is pushed to press the pushbutton 78*a*. Then, the movable contact is released from the fixed contact 80 by the pushbutton 78*a* which is pressed by the tapered edge 64*a*. The pushbutton 78*a* is then released from the fixed contact 80 and brought into contact with the fixed contact 82 under the force of the leaf spring to enefgize or de-energize the circuit. Likewise, turning movement of the lever member 54 to enables the slidable plate 62 to lift the steel ball 86*b* or 86*c*, so that the contacts in the microswitch 72*b* or 72*c* can be opened and closed.

Figure 6:
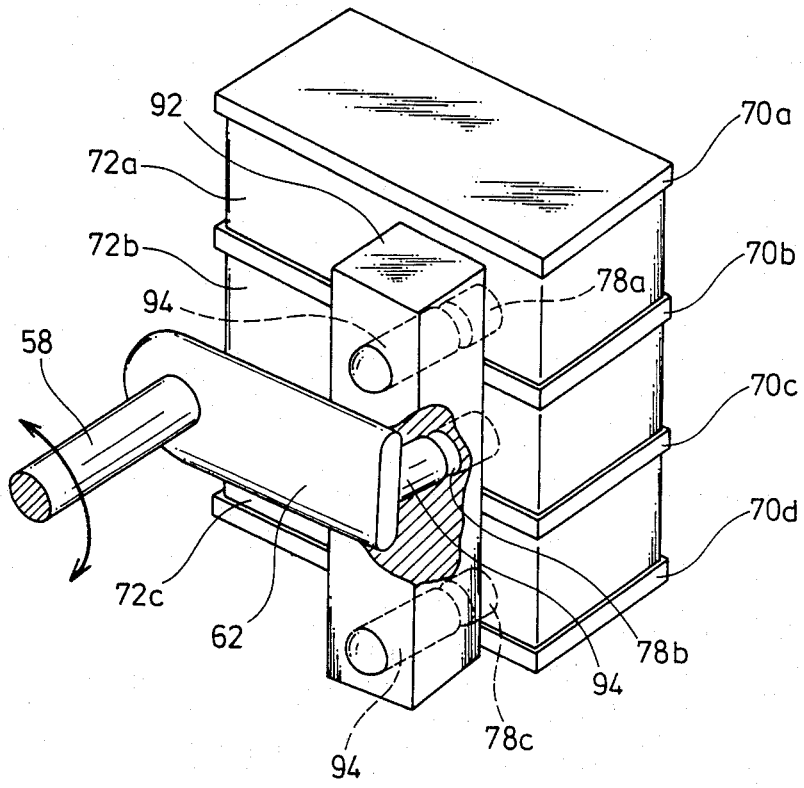
FIG. 6 is a perspective view, with parts omitted from illustration, of a lever switch according to still another embodiment of the present invention.

FIG. 6 shows a lever switch according to still another embodiment of the invention. In this embodiment, a prismatic holder 92 which is relatively thick is employed in place of the plate 90. The prismatic holder 92 has holes defined therein and receiving cylindrical bodies 94 movably disposed therein and having bottoms held in contact with the pushbuttons 78*a* through 78*c*, respectively. The cylindrical bodies 94 have semispherical heads. The pressing member 62 preferably has rounded longitudinal edges. The slidable plate 62 with the rounded longitudinal edges are angularly displaced to press one of the cylindrical bodies 94 to push the corresponding pushbutton 78*a*, 78*b*, 78*c*. Therefore, the lever switch of FIG. 6 operates in the same manner as the lever switches of the previous embodiments of the invention.

With the present invention, as described above, spherical bodies, rollers, or cylindrical bodies are disposed in confronting relation to the pushbuttons of microswitches, and are displaced by a plate or the like into selective pressing engagement with the pushbuttons for energizing or de-energizing electric circuits. The lever switch of the invention has many practical advantages. For example, switching operation of the switch is easy to perform. The switch is simple in construction and inexpensive to manufacture. Since the electric circuits and the mechanical construction are separated from each other, the switch can effect reliable switching operation. Maintenance of the switch is simplified.

Although certain preferred embodiments have been shown and described, it should be understood that many changes and modifications may be made therein without departing from the scope of the appended claims.

What is claimed is:

1. A lever switch comprising:

(a) a plurality of microswitches arranged along a line and having respective pushbuttons;

(b) a plurality of first pressing members comprising rolling bodies, respectively, which are operatively provided adjacent to said pushbuttons;

(c) means for selectively holding said first pressing members at a predetermined position;

(d) a second sole pressing member provided adjacent to said first pressing members; and (e) a lever member for displacing said second pressing member to selectively displace said first pressing members for selectively pressing said pushbuttons to open or close said microswitches.

2. A lever switch according to claim 1, wherein each of said first pressing members comprises a rolling body.

3. A lever switch according to claim 2, wherein said rolling body comprises a spherical body.

4. A lever switch according to claim 3, wherein said spherical body comprises a steel ball.

5. A lever switch according to claim 2, wherein said rolling body comprises a roller.

6. A lever switch according to claim 1, wherein said second pressing member comprises a plate having tapered opposite edges.

7. A lever switch according to claim 1, wherein said second pressing member comprises a plate having rounded opposite edges.

8. A lever switch according to claim 1, including a support on which said microswitches are supported in juxtaposed relation, and a holder plate on which said first pressing members are rotatably supported.

* * * * *